US006547470B2

(12) United States Patent
Legg

(10) Patent No.: US 6,547,470 B2
(45) Date of Patent: Apr. 15, 2003

(54) RETRACTABLE COMBINATION PEN AND SCREWDRIVER

(76) Inventor: Larry Legg, 5325 Blair Rd., Perry, OH (US) 44081

( * ) Notice: Subject to any disclaimer, the term of this patent is extended or adjusted under 35 U.S.C. 154(b) by 0 days.

(21) Appl. No.: 09/682,885

(22) Filed: Oct. 30, 2001

(65) Prior Publication Data

US 2002/0081139 A1 Jun. 27, 2002

Related U.S. Application Data

(60) Provisional application No. 60/273,457, filed on Mar. 5, 2001, and provisional application No. 60/244,615, filed on Oct. 31, 2000.

(51) Int. Cl.[7] ..... B43K 29/00

(52) U.S. Cl. ..... 401/195; 401/52; 401/99; 401/109; 401/110; 401/111

(58) Field of Search ..... 401/52, 195, 99, 401/103, 104, 109–114

(56) References Cited

U.S. PATENT DOCUMENTS 5,568,741 A 10/1996 Parsons
5,600,348 A 2/1997 Bartholow et al.
5,916,278 A 6/1999 Garcia
6,135,661 A 10/2000 Houser
6,205,893 B1 3/2001 Sato
6,233,770 B1 5/2001 Garcia
6,273,582 B1 8/2001 Taggart et al.
6,331,087 B1 12/2001 Wang

*Primary Examiner*—Gregory Huson
*Assistant Examiner*—Tuan Nguyen
(74) *Attorney, Agent, or Firm*—Buckingham, Doolittle & Burroughs, LLP

(57) ABSTRACT

A combination tool capable of being clipped into a pocket which incorporates an outwardly biased writing implement, e.g., pen, into a tip of a removable Phillips-head screwdriver tip at one end of a hexagonal tube while having a removable second tip, e.g., regular screwdriver tip at an opposed end. The handle, an inwardly biased clip affixed thereto for fastening into a shirt or pant pocket, is used for facilitating rotational movement of the hexagonal tube with screw tips attached, and is insertable over either tip and at least partially onto the hexagonal tube, an interior hole within the handle being dimensioned so as to permit sliding frictional engagement between the handle and the tube. In a preferred embodiment, the pen has a selectively retractable tip, retracting effected by converting inward radial force into compressive longitudinal movement.

38 Claims, 2 Drawing Sheets

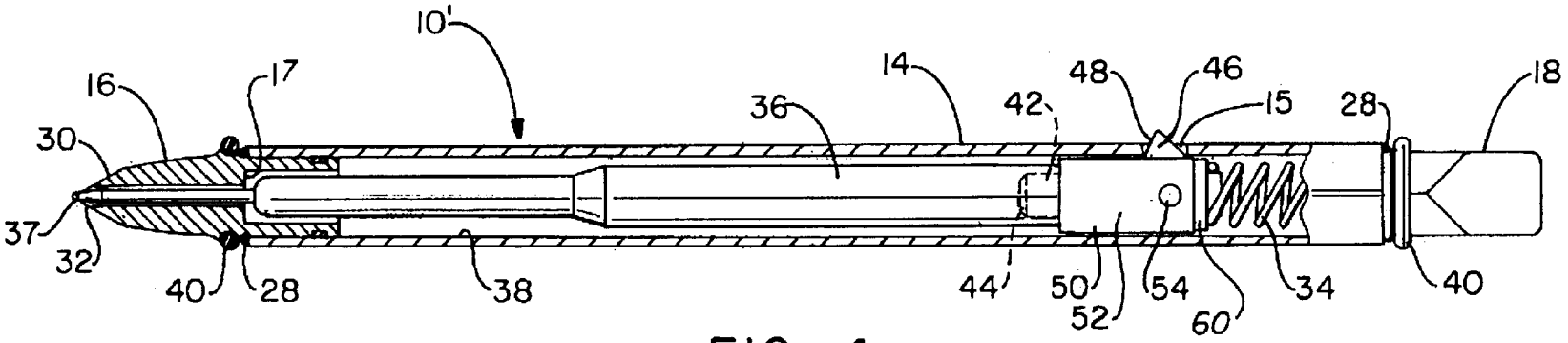
FIG.-4
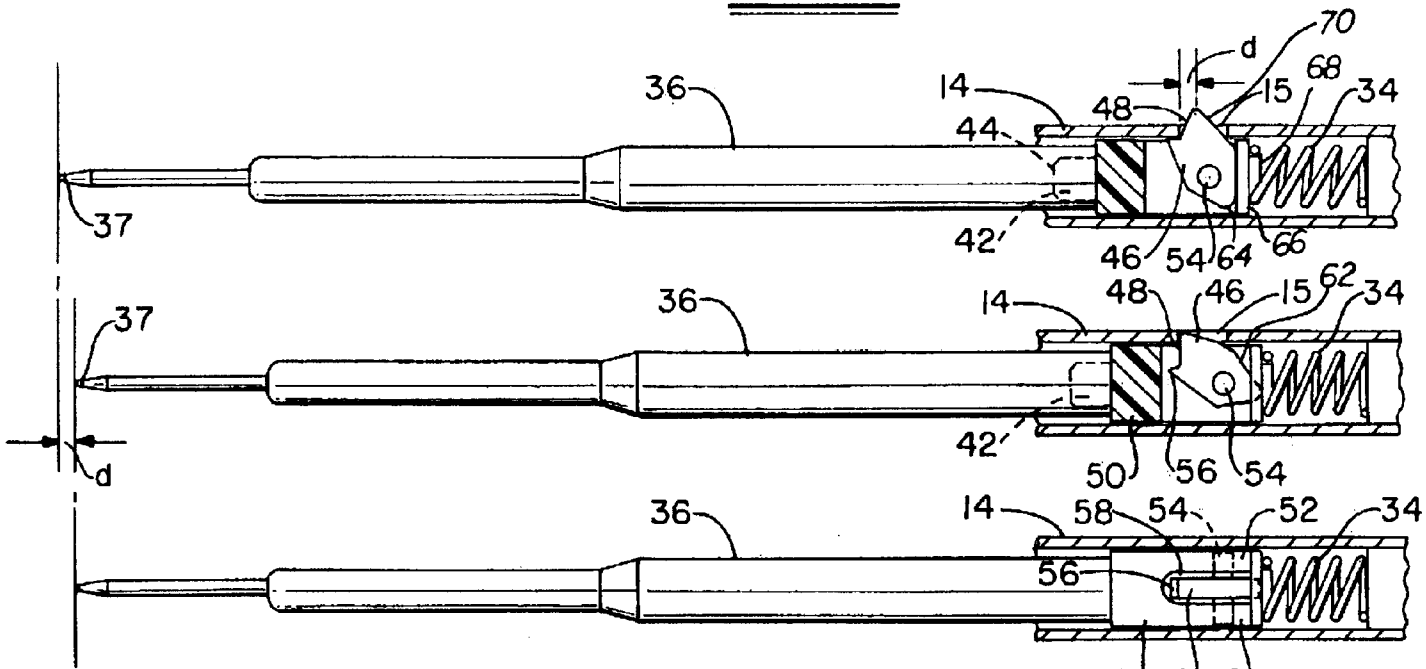
FIG.-5
FIG.-6
FIG.-7

RETRACTABLE COMBINATION PEN AND SCREWDRIVER

BACKGROUND OF INVENTION

The invention relates to a combination tool capable of being clipped into a pocket which incorporates an outwardly biased writing implement, e.g., pen, into a tip of a removable Phillips-head screwdriver tip at one end of a tube, which is at least partially non-circular at opposing ends thereof, i.e., triangular, square, hexagonal, etc., while having a removable second tip, e.g., regular screwdriver tip at an opposed end. The handle, having a clip, typically inwardly biased, affixed thereto for fastening into a shirt or pant pocket, is used for facilitating rotational movement of the tube with screw tips attached, and is insertable over either tip and at least partially onto the tube, an interior hole within the handle being dimensioned so as to permit sliding frictional engagement between the handle and the tube. In one aspect of the invention, the outwardly biased writing implement is retractable by depression of a rocker arm through sliding engagement of the handle over a surface of the tube at the end of the tube opposed to the pen tip.

The ability to combine the characteristics of writing implements with utilitarian products has met with limited to non-existent success. To that end, typical utilitarian tools, e.g., screwdrivers, have not been combined with writing implements such as pens or other ink-based tools. One reason for this is believed to be due to the lack of recognition of the value of having an outwardly biased writing implement which retracts automatically upon the application of force in a direction opposite to the axis of the biasing force which exceeds the predetermined biasing force value, which then permits normal utilization of an implement such as a Philips-head screwdriver tip with a Philips head screw.

While the outwardly biased feature is acceptable, it is even more desirable to have an automatically retracting mechanism by which the pen resident within the housing is retracted upon insertion of a handle over the end of the tool opposed to the pen tip, which through depression of the rocker arm will automatically retract the pen through mating engagement with a plug affixed to the rocker arm.

SUMMARY OF INVENTION

The invention is a creative use of mechanical engineering which combines design with function.

It is an object of this invention to provide a combination tool which serves as both a writing implement and as a driver for mechanical fasteners, such as screws.

It is another object of this invention to provide a mechanical fastener driving tool having a removable cap which serves as a tool handle facilitating rotational movement about a longitudinal axis of the tool.

It is still another object of this invention to provide a combination tool which has an outwardly biased pen penetrating from the Phillips-head screwdriver tip affixed at one end of the tool.

It is still yet another object of this invention to provide a combination tool which has a rocker arm which when depressed will retract the tip of the outwardly biased pen inside the Phillips-head screwdriver tip upon contacting engagement of the handle with a rocker arm at an end opposed to Phillips-head screwdriver tip.

These and other objects of this invention will be evident when viewed in light of the drawings, detailed description, and appended claims.

BRIEF DESCRIPTION OF DRAWINGS

The invention may take physical form in certain parts and arrangements of parts, a preferred embodiment of which will be described in detail in the specification and illustrated in the accompanying drawings which form a part hereof, and wherein:

FIG. 4 is a side elevational view, in partial cross-section, of a second embodiment illustrating a pen retracting device forming part of the invention;

FIG. 5 is a partial side elevational view and in partial cross-section illustrating the pen retraction device showing the pen in the use or writing position;

FIG. 6 is a partial side elevational view similar to that shown in FIG. 5 illustrating the pen in a retracted position; and FIG. 7 is a partial top view of the elements shown in FIG. 6 with the pen in a retracted position.

DETAILED DESCRIPTION

Figure 2:
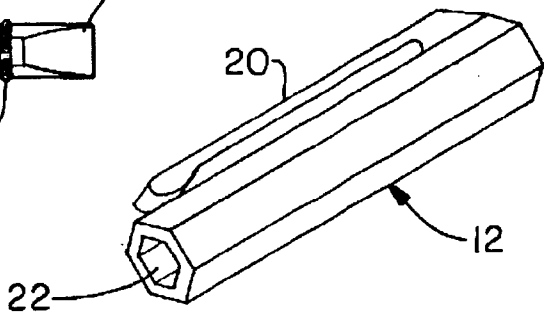
FIG. 2 is a perspective view of a cap as may be applied to either end of the invention for a pen-screwdriver.

Referring now to the drawings wherein the showings are for purposes of illustrating the preferred embodiment of the invention only and not for purposes of limiting the same, the Figures show the combination screwdriver and pen of the instant invention.

Figure 1:
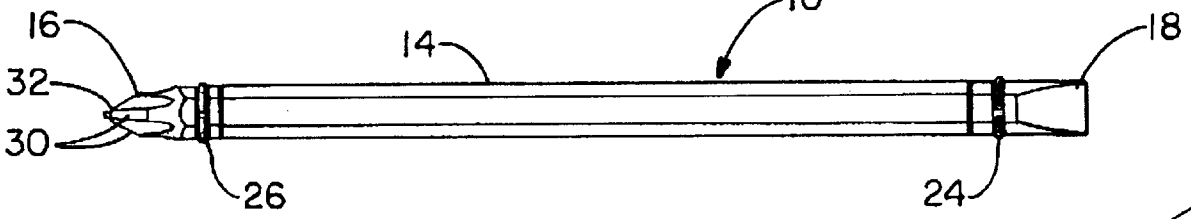
FIG. 1 is a side elevational view of a pen-screwdriver according to the present invention.

As seen in FIGS. 1 and 2, the combination screwdriver and pen 10 comprises a removable cap 12, a housing 14 which is removably insertable into mating bore 22 of cap 12, and at least one, preferably two tool tips (16, 18) affixed into opposed ends of the housing body 14. While the housing body is shown as hexagonal, the invention is not limited to such a geometry. It is preferred that the housing body 14 contain at least three sides so as to provide a surface to facilitate rotational movement about a longitudinal axis of the housing body 14. If the outer geometry of the housing were completely circular, then mating insertion of the removable cap 12 would limit the amount of torque which could be generated to the amount of friction between the outer body housing and the mating bore 22 contained with the removable cap 12, and in a less preferred embodiment, this may be acceptable for some end use applications.

The housing body 14 has at least one centrally disposed longitudinal bore at one end of the body, although more preferably, the tool will have two centrally disposed longitudinal bores at each longitudinal end for mating insertion of at least one, and preferably two, tool tips. The bores need not be the same length, nor the same internal diameter or geometry, those factors being determined by the tool tip chosen for insertion and the location of the pen within a bore. In an alternative embodiment, a centrally disposed longitudinal bore will extend completely through the tool.

Figure 3:
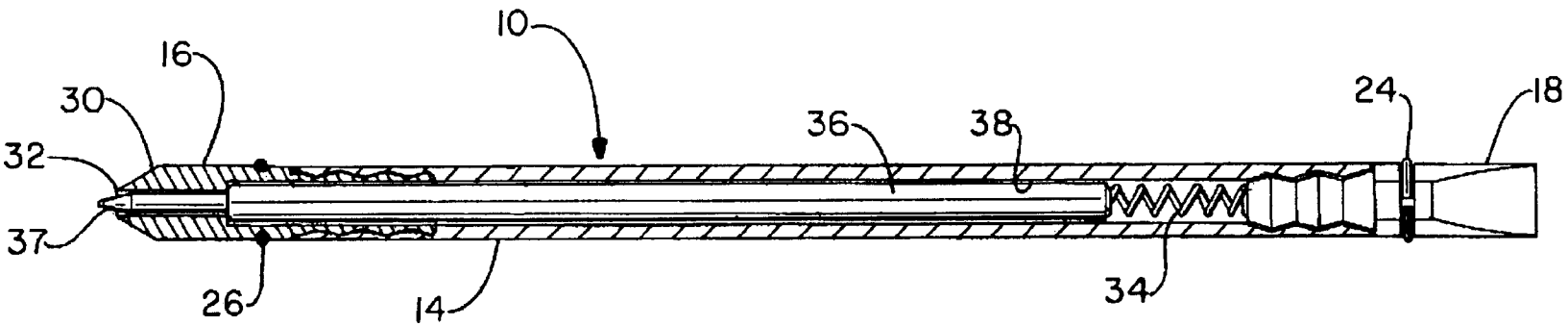
FIG. 3 is an enlarged side elevational view, in partial cross-section, illustrating various elements comprising the invention.

As better illustrated in FIGS. 1 and 3, housing body 14 has two ends adapted for receiving tool tips and securely holding the same during use of the tool. In the figure, housing body 14 is shown having a regular screwdriver tip 18 affixed to a first end and a cross head, star or Phillips-type tip 16 affixed to an opposed second end. A pair of O-rings 24, 26 are optionally incorporated to fit into an annular ring grooved about a circumference of each tip to facilitate frictional engagement with the mating internal geometry of the internal bore 22 of the cap 12. As illustrated from a combination of FIGS. 1 and 3, either tip affixed to each longitudinal end of the housing body 14 is insertable into the internal bore 22 of cap 12. In one aspect of this invention, the cap serves both as a protective device for the writing implement as well as to facilitate rotational movement about a longitudinal axis of the tool. In a preferred embodiment, the cap further includes an external clip 20 as shown as FIG. 2. Optionally, the clip typically has an inward bias to promote retention of the product within a pocket of a user.

As shown in FIGS. 1, and 3, the writing implement 36 of the combination screwdriver and pen is contained within a longitudinal bore 38 within housing body 14 and is outwardly longitudinally biased so as to protrude from the Phillips-type tip 16 at an apex 32 of the congruence of the fins 30 of the cross head end. The biasing means 34 is typically a spring although other known biasing means are envisioned to be within the scope of this invention. In this embodiment, the screwdriver tip 16 is shown as being attached to the housing body 14 via a series of mating threaded screw flights, although other fastening mechanisms, e.g., friction are also envisioned. A longitudinal bore within the Phillips head tip is dimensioned at its peripheral exterior end so as to prevent complete egress of the writing implement 38, i.e., a stop means which is a shelf within the Phillips head tip 16.

When the combination screwdriver and pen 10 product is used as shown in FIGS. 1 and 3, then the biasing spring 34 maintains forward positive outwardly directed force on the writing implement, e.g., pen 36 and permits the user to use the product as if it were strictly a writing implement, e.g., a pen. However, upon the application of a force which exceeds the longitudinal outwardly-biasing force generated by the biasing means 34, the tip 37 of the pen 36 will retract and the product will be capable of being used as a Phillips-head screwdriver 16, the fins 30 not slipping out of the mating slots in the screw head due to the fact that the pen tip apex 37 will have retracted within the bore 38 of the body 14.

In a preferred embodiment of the invention, and illustrated in FIGS. 4–7, the combination pen and screwdriver tool 70, is shown with a pen retractability feature, the retraction mechanism predicated not in response to longitudinal force generated by a user exceeding the outwardly biasing force as shown in FIG. 1, but rather in response to insertion of the cap 12 onto the housing body 14. As illustrated in the Figures, pen tip 37 is shown fully extended in FIG. 5, and fully retracted in FIGS. 6–7, the retractive movement being effected by inward depression of rocker arm 46 as cam surface 48 bears against the housing slot 75 effecting longitudinal rearward movement of distance d of connector 50 in engagement (frictional) with pen writing implement 36.

Connector 50 is a yolk-shaped connector having a pair of arms 52 defining an elongated slot 58 within which is positioned a rocker arm 46 with a lip stop 56 and with pivotal movement effected about a pivot pin 54 affixed through each yolk arm 52 and a mating aperture within rocker arm 46. At a bottom of the connector is a stub 42, optionally having a beveled surface 44 thereupon, for insertion (typically frictional engagement) into an inner diameter of the writing implement 36. At an opposed end of connector 50 is a cap 60 positioned for engagement with the tops of the yolk arms 50 of the connector. The cap has a inwardly facing dimple on an underside of a bottom member 66 of the cap for sliding engagement with a tip 64 of cam surface 62 of the rocker arm 46. The cap has an upper member 68 for engagement with one end of a biasing means 34.

In operation, upon the insertion of cap 12 with corresponding frictional engagement with cam surface 70 of rocker arm 46, inward movement of the rocker arm is effected which through sliding engagement of cam surface 70 of the rocker arm, is translated into rearward longitudinal movement of a distance d of the entire connector assembly 50, thereby effectively retracting the writing implement tip 37 of the pen 36 and the product will be capable of being used as a Phillips-head screwdriver 16, the fins 30 not slipping a out of the mating slots in the screw head due to the fact that the pen tip 37 will have retracted within the bore 38 of the housing body 14.

Rocker arm 46 has a stop means 56 to prevent radial movement of the protruding tip beyond a defined number of degrees as measured from a longitudinal axis of housing body 14. In a preferred embodiment, this angle is between 10° and 50° inclusive. In a more preferred embodiment, this angle is between 20° and 40° inclusive, and in a most preferred embodiment, this angle is approximately 30°. The tip protrudes a distance of approximately 1/16" from the surface of the tool housing body 14.

In the embodiment shown in FIG. 4, pen cartridge is held disposed within housing 14 by a pair of split metal O-rings 28, only one of which is shown. Sliding engagement of the cap is facilitated by a pair of rubber O-rings 40.

This invention has been described in detail with reference to specific embodiments thereof, including the respective best modes for carrying out each embodiment. It shall be understood that these illustrations are by way of example and not by way of limitation.

What is claimed is:

1. A tool which comprises:

(a) a tubular housing having a central bore and two ends;

(b) a flat head screwdriver tip for mating engagement at one end and a cross head screwdriver tip at the opposite end, the cross head screwdriver tip has a centrally disposed bore therethrough;

(c) a writing means disposed within the bore of said cross head tip; and (d) a biasing means within said housing bore exerting a predetermined longitudinal peripheral biasing force to said writing means, such that upon the application of an opposing force which exceeds said predetermined longitudinal peripheral biasing force, said writing means is retracted into said cross head tip.

2. The tool of claim 1 wherein said housing has at least 3 exterior sides.

3. The tool of claim 2 wherein said exterior of said housing is a polygon having 4 to 8 sides inclusive.

4. The tool of claim 3 wherein said polygon has 6 sides.

5. The tool of claim 2 which further comprises a removable cap having a centrally disposed bore at least partially disposed therethrough for mating engagement with an exterior of said housing.

6. The tool of claim 5 wherein said cap has a clip affixed to at least one exterior side.

7. The tool of claim 1 wherein said cross head tip has an annular groove.

8. The tool of claim 7 wherein an O-ring is positioned within said annular groove.

9. The tool of claim 8 wherein said cross head tip has a stop means for preventing said writing means from completely egressing from said tip.

10. The tool of claim 9 wherein said stop means is a shelf within said bore of said cross head tip.

11. The tool of claim 10 wherein said biasing means is a spring.

12. A tool which comprises:

(a) a tubular housing having a central bore and two ends;

(b) a flat head screwdriver top for mating engagment at one end and a cross head screwdriver tip at the opposite end;

(c) the cross head screwdriver tip has a centrally disposed bore;

(d) a writing means disposed within cross head tip bore in mating engagement with a longitudinal connector;

(e) a biasing means exerting an outwardly directed longitudinal biasing force to said writing means; and (f) a selectively positionable retraction means interposed between said longitudinal movement means and said biasing means, said selective movement being from a first position to a second position.

13. The tool of claim 12 wherein said housing has at least 3 exterior sides.

14. The tool of claim 13 wherein said exterior of said housing is a polygon having between 4 and 8 sides inclusive.

15. The tool of claim 14 wherein said polygon has 6 sides.

16. The tool of claim 12 which further comprises a removable cap having a centrally disposed bore at least partially disposed therethrough for mating engagement with an exterior of said housing.

17. The tool of claim 16 wherein said cap has a clip affixed to at least one exterior side.

18. The tool of claim 12 wherein said cross head tip has an annular groove.

19. The tool of claim 18 wherein an O-ring is positioned within said annular groove.

20. The tool of claim 19 wherein said cross head tip has a stop means for preventing said writing means from completely egressing from said tip.

21. The tool of claim 20 wherein said stop means is a shelf within said bore of said cross head tip.

22. The tool of claim 21 wherein said biasing means is a spring.

23. The tool of claim 12 wherein said longitudinal movement connector comprises:

(a) a main housing capable of sliding movement within the tubular housing;

(b) a cylindrical projection for mating frictional engagement with a tubular aperture of said writing means on one side of said main housing;

(c) a yoke on an opposed side of said main housing, said yoke having a slot disposed therein for insertion of a rocker arm therein.

24. The tool of claim 23 wherein (a) said yoke further comprises a pair of extending arms, each arm having a hole disposed therein for insertion of a pin therein.

25. The tool of claim 24 wherein said rocker arm further comprises an aperture therein aligned with said holes within each of said arms of said yoke.

26. The tool of claim 25 wherein said rocker arm has a projection which extends through a hole in a wall of said tubular housing.

27. A tool which comprises:

(a) a tubular housing having a central bore and two ends;

(b) a flat head screwdriver tip for mating engagement at one end and a cross head screwdriver tip at the opposite end;

(c) the cross head screwdriver tip has a centrally disposed bore therethrough;

(d) a writing means within said cross head tip bore in mating frictional engagement with a yoke-shaped longitudinal movement connector having a pair of extending arms, each arm having an aperture disposed therein;

(e) a biasing means exerting an outwardly directed longitudinal biasing force to said writing means; and (f) a selectively positionable retraction means interposed between said longitudinal movement connector and said biasing means, said selective movement being from a first position to a second position;

(g) said retraction means further comprising:

(i) a rocker arm having at least one exteriorly penetrating arm through an aperture in said tubular housing and pivotably connected to said longitudinal movement connector by a pin inserted through said holes of said arms and an aperture in said rocker arm.

28. The tool of claim 27 wherein said housing has at least 3 exterior sides.

29. The tool of claim 28 wherein said exterior of said housing a polygon having 4 to 8 sides inclusive.

30. The tool of claim 29 wherein said polygon has 6 sides.

31. The tool of claim 29 which further comprises a removable cap having a centrally disposed bore at least partially disposed therethrough for mating engagement with an exterior of said housing.

32. The tool of claim 27 wherein said cross head tip has an annular groove.

33. The tool of claim 32 wherein an O-ring is positioned within said annular groove.

34. The tool of claim 27 wherein cross head tip has a stop means for preventing said writing means from completely egressing from said tip.

35. The tool of claim 34 wherein said stop means is a shelf within said bore of said cross head tip.

36. the tool of claim 35 wherein said biasing means is a spring.

37. A tool which comprises:

(a) a tubular housing having a central bore and two ends, an exterior of said housing is a polygon having between 4 to 8 sides;

(b) a flat head screwdriver tip for mating engagement at one end and a cross head screwdriver tip at the opposite end;

(c) the cross head screwdriver tip has a centrally disposed bore therethrough;

(d) a writing means disposed within said cross head tip bore in mating engagement with a longitudinal movement connector;

(e) a biasing means exerting an outwardly directed longitudinal biasing force to said longitudinal movement connector; and (f) a selectively positionable means converting inward radial movement into longitudinal movement by the longitudinal movement means.

38. The tool of claim 37 wherein said selectively positionable means moves from a first position to a second position by insertion of a removable cap having a centrally disposed bore at least partially disposed therethrough for mating engagement with an exterior of said housing.

* * * * *